US005943962A

United States Patent [19]

Birkhahn et al.

[11] Patent Number: 5,943,962

[45] Date of Patent: Aug. 31, 1999

[54] DEVICE FOR COUNTERACTING TRANSVERSE FORCES ACTING ON A RAIL VEHICLE

[75] Inventors: Gundolf Birkhahn, Lohr; Manfred Düsing, Aachen; Karl Lengl, Lohr; Yuan Lü, Herzogenrath; Wolfgang Schäfer, Triefenstein, all of Germany

[73] Assignee: Mannesmann Rexroth AG, Lohr/Main, Germany

[21] Appl. No.: 08/930,138

[22] PCT Filed: Mar. 27, 1996

[86] PCT No.: PCT/EP96/01341

§ 371 Date: Oct. 3, 1997

§ 102(e) Date: Oct. 3, 1997

[87] PCT Pub. No.: WO96/31385

PCT Pub. Date: Oct. 10, 1996

[30] Foreign Application Priority Data

Apr. 3, 1995 [DE] Germany ..... 195 12 437

[51] Int. Cl.[6] ..... B61F 3/00

[52] U.S. Cl. ..... 105/199.2

[58] Field of Search ..... 105/199.1, 199.2, 105/453

[56] References Cited

U.S. PATENT DOCUMENTS 4,363,277 12/1982 Martin et al. ..... 105/199.2
5,170,716 12/1992 Durand et al. ..... 105/199.2
5,454,329 10/1995 Liprandi et al. ..... 105/199.2

*Primary Examiner*—Robert J. Oberleitner
*Assistant Examiner*—Robert J. McCarry, Jr.
*Attorney, Agent, or Firm*—Martin A. Farber

[57] ABSTRACT

A device for compensating for the transverse forces acting on a rail vehicle whose car body is supported via spring action on at least one undercarriage and which can be displaced via a transverse compensator in transverse direction with respect to the undercarriage, a transverse spring action is associated for the buffering of dynamic oscillations, which can be connected or disconnected optionally as a function of the condition of travel.

13 Claims, 5 Drawing Sheets

DEVICE FOR COUNTERACTING TRANSVERSE FORCES ACTING ON A RAIL VEHICLE

FIELD AND BACKGROUND OF THE INVENTION

The present invention relates to a device for the car body (2) of which is supported by a spring action (3, 3') on at least one undercarriage (4), having a transverse compensator (12) which can be controlled via a control circuit (24) for shifting the car body transverse to the undercarriage, in accordance with the preamble to claim 1.

Such a device for compensating for centrifugal forces, known for instance from DE-OS 40 40 047, referred to in the following as a transverse compensation device, is used among other things on railroad cars and driving units of railway trains. In this case, as a rule, the body of the car is supported via pneumatic cushioning in vertical and horizontal direction on two trucks and, in addition, the transverse compensation device is provided between the body of the car and the trucks.

The known device has a hydraulic or pneumatic cylinder the working section of which, for instance the cylinder, acts on the truck, while the other working section, in this case the piston, is articulated to the body of the car. The axis of action of the cylinder is, in this connection, transverse to the longitudinal axis of the rail vehicle. Ordinarily, such trains are equipped with a car-body inclination system by which the car body, upon passing over a curve, can be so inclined towards the inside of the curve as a function of the radius of curvature of the curve and of the speed of the vehicle, that the fewest possible lateral forces act on the passenger. This technology therefore, when taking as basis the maximum possible lateral acceleration on the passenger without loss in the comfort of travel, permits substantially higher speeds around curves than with trains which are equipped with a traditional undercarriage.

Regardless of whether a rail vehicle is or is not equipped with the car-body inclination system, the car body can be actively displaced laterally with respect to the truck by a transverse compensation device. The car body is held in approximately its central position by the transverse compensation device despite the centrifugal force acting on it, so that the transverse spring action of the rail vehicle upon travel straight-ahead and travel around a curve lies in approximately the same region of its characteristic curve in which a weaker spring action is obtained than in a region in which the car body is displaced strongly laterally and rests against rubber bumpers having a steep characteristic (hard cushioning). Furthermore, the axis of sway of the car body can be set by the transverse compensation device at a predetermined (desired) position. The axis of sway is the virtual axis of rotation which extends parallel to the longitudinal direction of the vehicle and around which the car body turns upon travel around curves due to the centrifugal force which acts and possibly due to the action of the car-body inclination system. Ordinarily, it is attempted to set the axis of sway at approximately seat level or, more precisely, at the level of the passenger's stomach. In this way, assurance can be had even with high speeds around curves that the feeling of well-being of the passenger is not impaired by the effects of centrifugal force.

From EP-A 0 592 387, a transverse spring-action device is known with which, in a hydraulic variant, two hydraulic cylinders which are arranged in opposition to each other are provided and can be controlled so as to increase, when necessary, the transverse spring forces produced by the secondary spring action upon quasi-static transverse displacements of the car body.

Upon the use of said systems, it has been found that they are fully capable, upon travel around curves, of intercepting the quasi-static centrifugal forces caused by the centrifugal acceleration or minimize their negative effects on the passenger. On the quasi-static centrifugal forces, however, there are regularly superimposed dynamic forces which are transmitted to the car body by, for instance, unevenness in the track or by so-called passive forces, i.e. swinging motions produced by the rail vehicle itself.

In the case of rapidly responding transverse compensation systems these swinging motions can lead to corresponding reactions in the control circuit, so that, under given conditions of travel, and particularly when traveling around curves, there may be continuous changes in the position of the car body transverse to the undercarriage, so that the smoothness in travel of the rail vehicle on curves may not satisfy the high demands made.

If, however, the control is made so slow that it does not respond to the dynamic swinging, the desired comfort in travel can also not be obtained.

SUMMARY OF THE INVENTION

Therefore, the object of the invention is to create a device for compensating for the transverse forces acting on the rail vehicle which, with minimum expense for apparatus, assures high comfort in travel, even upon travel around curves.

This object is achieved by measure of associating with the transverse compensation device not only the normal spring action and the transverse compensator, but also a transverse spring action, the dynamic swinging forces which act in transverse direction on the rail vehicle can be substantially intercepted by the combined action of the secondary spring action of the car body and the additional transverse spring action so that the smoothness in travel of the rail vehicle is quite considerably improved as compared with traditional solutions.

Furthermore, by the device in accordance with the invention, the result is obtained that the car body is inclined to the outside of the curve substantially only on the basis of the quasi-static centrifugal forces. An additional inclination caused by the dynamic oscillations is substantially prevented by the transverse spring system. The clearance gauge, which determines the maximum inclination of the car body, is not trespassing upon by the deflection action of the dynamic swingings.

The transverse spring action thus permits travel with higher speeds around curves, without trespassing on the clearance gauge. Furthermore, excessively high transverse accelerations are effectively buffered.

It has been found to be particularly advantageous if the transverse spring action is developed as passive system with a hydraulic accumulator, preferably a gas accumulator. For certain conditions of travel, for instance when traveling straight ahead, it may be advantageous to disconnect the transverse spring action. Upon the use of a hydraulic accumulator, the connection to it can be developed so that it can be shut off. Upon the use of two parallel hydraulic accumulators with each of which a separate cylinder is associated, both accumulators can be temporarily connected to each other.

A system which is of particularly simple construction and operates reliably is obtained if the transverse compensator is developed with at least one cylinder, and preferably two cylinders, the one cylinder chamber of which can be controlled via a hydraulic circuit while the other cylinder chamber is connected in each case to a hydraulic accumulator.

Should such a configuration still prove to be too hard, this can be remedied by introducing greater elasticity, either mechanically (elastic mounting or suspension of the cylinders in the truck or undercarriage) or hydraulically by the installing of small additional hydraulic accumulators with gas-spring volumes (hydropneumatic elements) between the pressure supply and the cylinders (per branch of system).

The comfort in travel can be further increased if a damping device is associated with the transverse spring action, said damping device being preferably developed as a throttle valve with variable cross section of the diaphragm. By this further development, the separate transverse oscillation dampers which are necessary in traditional systems can be done away with. It is particularly advantageous to make the characteristic curve of said damping devices variable as a function of the transverse acceleration acting, the instantaneous speed of the vehicle, the quality of the track or line and/or the loading of the vehicle.

In one advantageous further development of the invention, there is provided, parallel to the damping device, a bypass line which has a non-return valve and permits a build-up of pressure in the cylinder while bypassing the damping device of a cylinder, so that the damping valve acts only in a forward direction of flow.

By the measure of developing in the cylinder chamber a reduction body which, upon a movement of the piston dips into a correspondingly shaped recess in the piston, the active surface in the cylinder chamber can be varied. In this way, the piston surface in the cylinder chamber and the piston surface in the annular space are adapted to each other. The use of a pump with comparatively high system pressure is possible, which, for example is in any event needed in order to control the active car body inclination system. Thus, a single pump can be used for different hydraulic systems of the rail vehicle; it can for example also effect the supplying of the hydraulic accumulators.

By a pressure reduction valve between the pump and the hydraulic cylinder, a predetermined pressure can be set in a feed line to the hydraulic cylinder.

BRIEF DESCRIPTION OF THE DRAWINGS

With the above and other objects and advantages in view, the present invention will become more clearly understood in connection with the detailed description of preferred embodiments, when considered with the accompanying drawings of which.

DETAILED DESCRIPTION OF THE PREFERRED EMBODIMENTS

Figure 1:
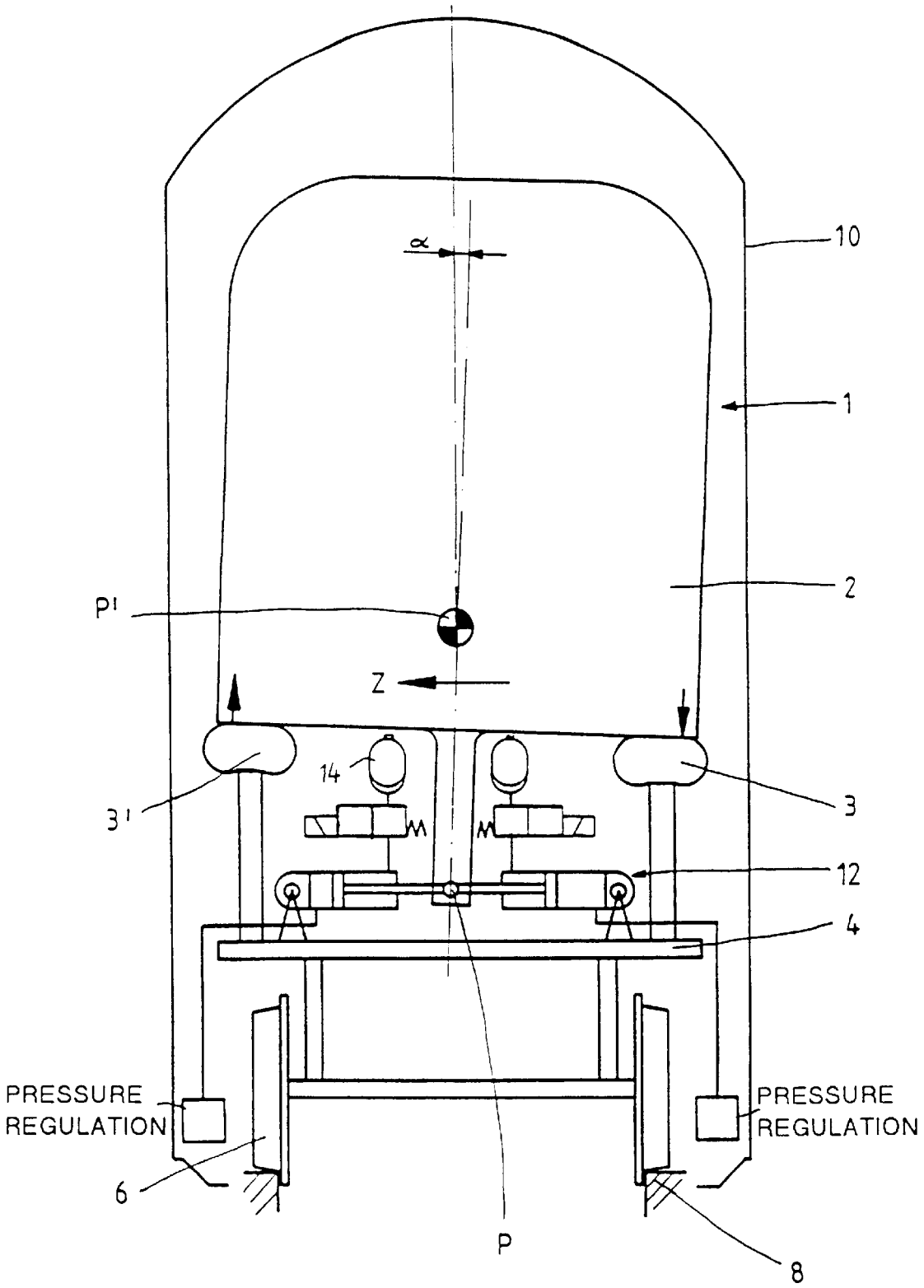
FIG. 1 is a cross section through a rail vehicle having a device in accordance with the invention for the compensating of transverse forces.

FIG. 1 shows a cross section through a rail vehicle 1 which is traveling around a curve. It has a car body 2 which is supported via spring action with air springs 3 on two trucks 4, only one of which is visible here. In each truck 4 there can be noted wheels 6, or groups of wheels, which roll on the rails 8 of a track. Upon travel around a curve, the car body 2 inclines due to the centrifugal forces and possibly due to the corresponding control of the car-body inclination system (not shown), the maximum angle of inclination a being established by an envelope curve of the so-called clearance gauge 10, which must not be trespassed upon by the rail vehicle 1 under any condition of travel.

In the event that the car-body inclination system shown in FIG. 1 is not active, the right-hand side of the rail vehicle 1 would be the outside of the curve towards which the car body 2 inclines as a result of the centrifugal forces. In this condition, the air spring which lies on the right in FIG. 1 is compressed while the air spring 3' which lies on the opposite side (the left side) is decompressed proportionally. The undercarriage of the rail vehicle 1 and its speed of travel are to be so determined that, even under limit conditions, the clearance gauge 10 is not trespassed upon, so that, for instance, upon travel through a tunnel there can be no collision with the wall of the tunnel or with structural parts arranged to the side of the track outside the said envelope curve.

In modern high-speed trains, a transverse compensator 12 is provided in the region between car body and truck, by means of which compensator, the car body can be displaced in horizontal transverse direction (y-direction) with respect to the truck 4.

In the condition of travel shown, the car body 2 could be pushed by the transverse compensator 12 to the left in the direction of the arrow Z from the central position shown, in which connection a virtual axis of sway P of the car body is raised from a position at the height of the truck 4 into a position P' at the height of the car body. By the controlled lateral deflection of the car body 2 the result is obtained on the one hand that, in the condition of travel shown in FIG. 1, the right-hand side of the car body is imparted a larger distance from the clearance gauge 10, so that a higher speed of travel is possible, while on the other hand the axis of sway is displaced by the transverse displacement into the region of the seats of the passengers, so that their subjective comfort of travel is substantially improved.

Figure 2:
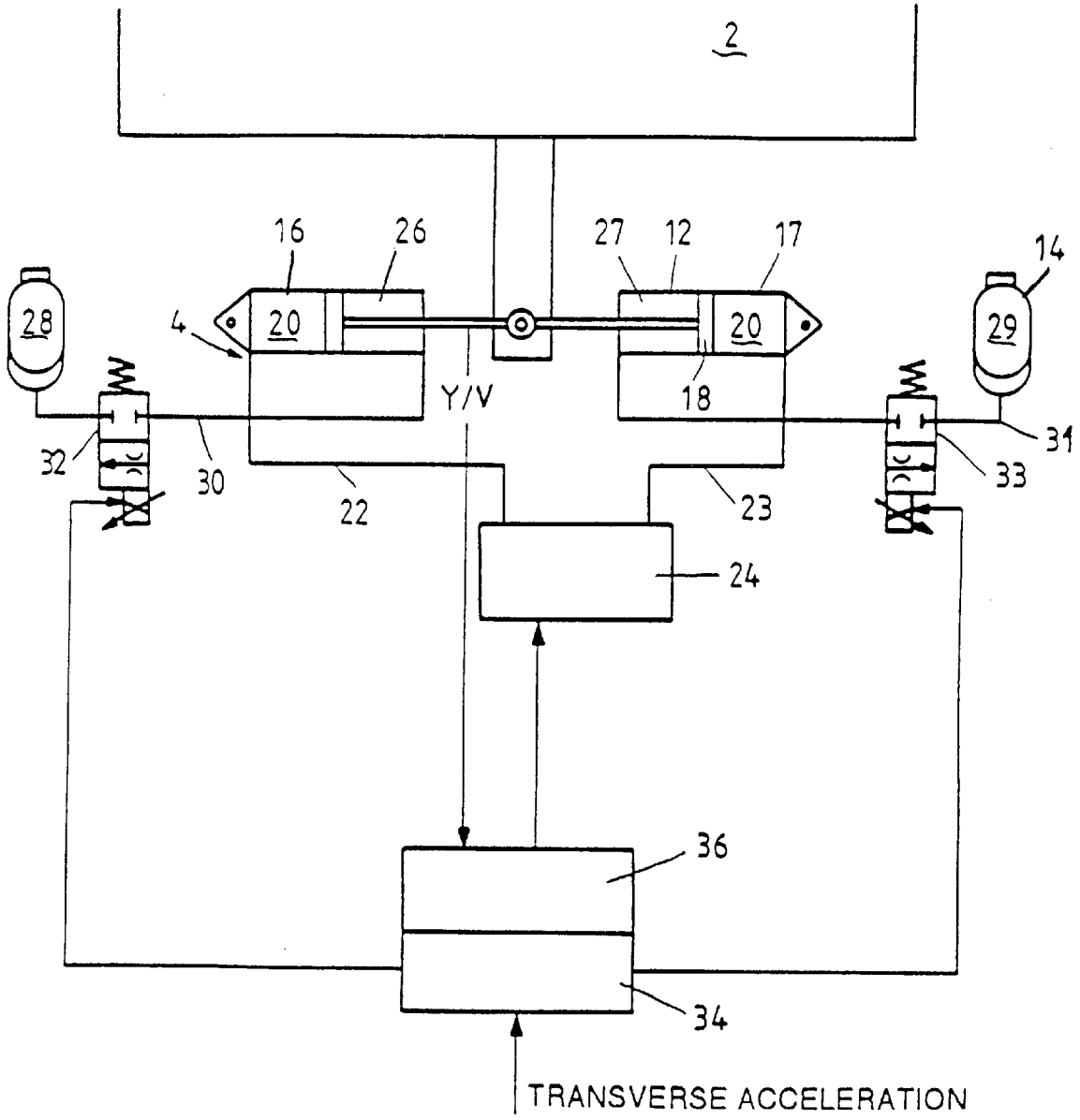
FIG. 2 is a diagrammatic showing of a transverse compensator with a transverse spring action.

A transverse spring action 14, the construction of which is shown diagrammatically in FIG. 2, is associated with the transverse compensator 12 shown in FIG. 1. The transverse compensator has two double-acting cylinders 16, 17, the cylinder housing of each of them being pivoted to the frame of the truck 4, while their respective pistons 18 are fastened by their oppositely arranged piston rods to the car body 2 (possibly via a drive pin). Of course, the positional orientation of the cylinders 16, 17 could also be kinematically reversed, so that the piston rods extend towards the truck while the cylinder housings are fastened to the car body.

The cylinder chambers 20 of both cylinders 16, 17 are connected via working lines 22, 23 to a hydraulic circuit 24, which will be explained in further detail below. To the annular spaces 26, 27 of the cylinders 16, 17 there are connected in each case a hydraulic accumulator 28, 29 respectively, developed preferably as gas accumulator, so that the movement of the pistons 18 takes place against the spring action of the hydraulic accumulators 28 and 29 respectively.

These two system branches are normally not connected to the system branches connected to the hydraulic circuit 24 so that a uniform, and therefore movement-neutral increase in pressure in the cylinder chambers 20 of the two cylinders 16, 17 cannot act directly on the pressures in the gas accumulators 28, 29.

The additional buffers for the obtaining of an even greater elasticity on the hydraulic side which have already been mentioned can be connected to the lines 22, 23 separated in accordance with system branches.

In order to increase the mechanical elasticity, the bearing lugs of the piston rods and/or cylinders could be mounted in rubber, the driver pin provided with a specific elasticity, etc. These advantageous options are not shown here.

Damping valves 32, 33 developed as proportional valves are provided in feed line 30, 31 to each hydraulic accumulator 28, 29. In a first end position (shown in FIG. 2), they close off the feed lines 30, 31. In the second end position and the transition positions, they permit the action of pressure on the associated annular space 26, 27 via the corresponding hydraulic accumulators 28, 29 with variable cross sections of flow. If both damping valves are shut off completely, then the connection between the annular spaces 26, 27 through the hydraulic accumulators is interrupted and the transverse compensation device is hydraulically blocked in its instantaneous position.

Each damping valve 32, 33 comprises a measuring diaphragm of variable cross section. By suitable control, the connections 30, 31 to the hydraulic accumulators 28, 29 can be variably controlled via the measuring diaphragm. Dynamic oscillations in the system or in the transverse compensator are intercepted by the damping valves and undesired movements of the car body are damped thereby. A control 34 controls the damping valves 32, 33, while the transverse compensator 12 is controlled by another control 36. The two systems can be controlled independently of each other, but they can be acted on as a function of one and the same measurement value, for instance the measured transverse acceleration of the rail vehicle or car body.

Although the transverse spring action 14 and the transverse compensator 12 are represented as a structural unit in the embodiment described here, the two systems can, if necessary, also be arranged separate from each other.

Figure 3:
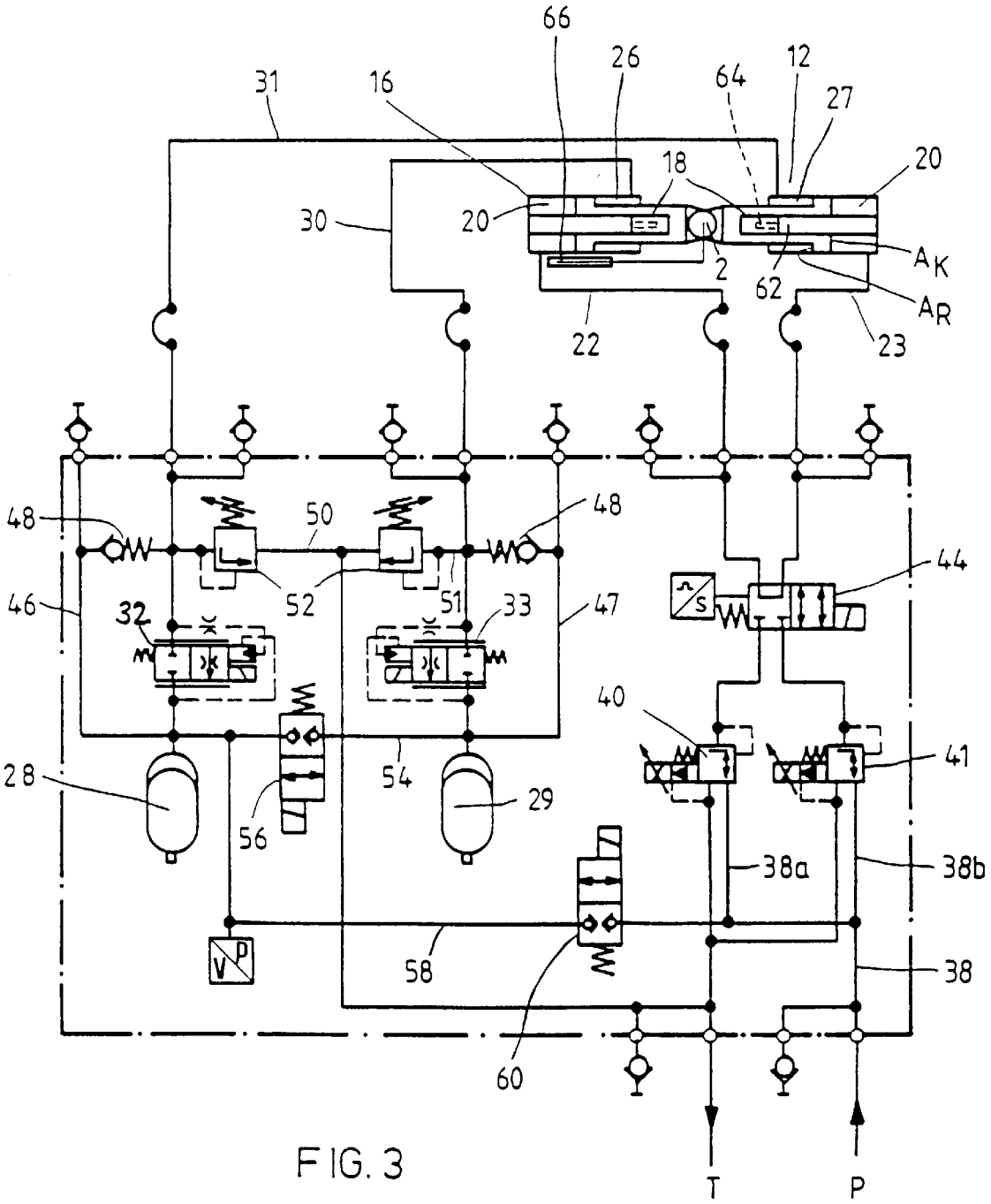
FIG. 3 is a hydraulic connection plan for one embodiment of a device for the compensation of transverse forces.

Further details of the hydraulic circuit can be noted from the diagram of connections shown in FIG. 3.

Accordingly, the two cylinder chambers 30 of the transverse compensator 12 are provided with hydraulic fluid via a pump P. For this, a pump line 38 which branches into branch lines 38*a* and 38*b* extends from the pump. These branch lines are conducted to input connections of a pressure reduction valve 40, 41 respectively. From the outlet of the corresponding pressure reduction valve, both pump lines are conducted to the input of the 4/2-way valve 44 which, in the switch position shown, blocks the two pump lines 38*a*, 38*b* off from the working lines 22, 23 but connects the latter to each other. In the second switch position of the directional valve 44, each branch line 38*a*, 38*b* is connected with a working line 22, 23, so that the two cylinder chambers 20 can be supplied with hydraulic fluid or the hydraulic fluid can also flow out again.

Since in the first switch position of the directional control valve 44, the two working lines 22, 23, and thus the cylinder chambers 20, are connected with each other, only hydraulic fluid is pumped back and forth between the cylinder chambers 20 upon a movement of the pistons 18 imparted from the outside. By suitable control of the electromagnetically actuatable pressure reduction valves 40, 41 the working lines 22, 23 can be connected optionally in a second switch position of the directional control valve 44 to the tank T (return flow). Thus, one cylinder chamber, for instance, can be supplied with pressure by the pump P while the hydraulic fluid in the other cylinder chamber is discharged by the commencement of the movement of the piston into the tank.

The valve slide of the damping valves 32, 33 is urged by spring into the locking end position shown. On the other side, the control side of the valve slide, the control pressure which is proportional to the difference between accumulator pressure and annular-space pressure, acts so that upon an increase in pressure in the annular space 26, (27) the damping valve 33, (32) is opened while, upon a decrease in the pressure it is closed. In the embodiment shown, the damping valves are controlled in such a manner that there is practically always a connection with the corresponding hydraulic accumulators 28, 29.

In each feed line 30, 31, parallel to the corresponding damping valve 32, 32, there is a bypass line 46, 47 in each of which bypass lines there is a non-return valve 48 which permits a flow of the hydraulic fluid from the hydraulic accumulator 28, 29 to the corresponding annular space 26, 27, while bypassing the damping valve.

Furthermore, from each feed line 30, 31 there branches off a tank line 50, 51 in each of which a pressure-limiting valve 52 is arranged. If the pressure increases above a permissible limit pressure in the feed line 30, 31, the hydraulic fluid is automatically discharged into the tank.

The two hydraulic accumulators 28, 29 are connected to each other via a short-circuit line 54 in which there is a switch valve 56. In its basic position shown in the drawing, it shuts off the short-circuit line 54. In its second switch position, it opens the short-circuit line 54. From the latter there branches off a pressure line 58 which can be connected with the pump line 38. For this purpose, there is provided between the pump line and the pressure line another switch valve 60 which, in its spring-urged basic position, interrupts the connection and in its second switch position permits the connection between pressure line and pump line.

As already mentioned at the start, the pump is a constant-pressure pump which can deliver, for instance, a pressure of about 200 bar. This pressure accordingly, aside from losses in line pressure, is present in front of the pressure-reduction valves 40, 41. In order to permit a corresponding damping action in the annular space 26, 27 and reduce the pressures to be supplied by the hydraulic accumulator 28, 29 to a permissible level, a reduction body 62 is provided in the cylinder chamber 20 of each cylinder 16, 17, said reduction body being developed as a pipe in the embodiment shown. The reduction body 62 extends in the axial direction of the cylinder in the direction of the piston into the cylinder chamber 20. In order to permit the movement of the piston, the bottom of the piston has a recess 64 in the form of a blind hole into which the reduction body can extend in fluid-tight manner. The space enclosed between the walls of the recess 64 and the end of the reduction body 62 is vented.

By the reduction body 62 which replaces a second piston rod with the advantage that it does not require any space for movement outside the cylinder, the piston surface is reduced by the cross-sectional surface of the reduction body, so that an active piston surface $A_K$ results. This corresponds approximately to the active piston surface $A_R$ in the annular space, so that the forces acting on the piston, with the same pressures on both sides of the piston, are approximately the same. Difference forces over the piston are negligibly small. This cylinder design thus permits the feeding of hydraulic fluid via the high pressure pump.

The oppositely arranged piston rods of the piston 18 are jointly pivoted on the car body 2. An (inductive) path recorder 66 is provided to detect the transverse displacement of the car body.

Figure 4:
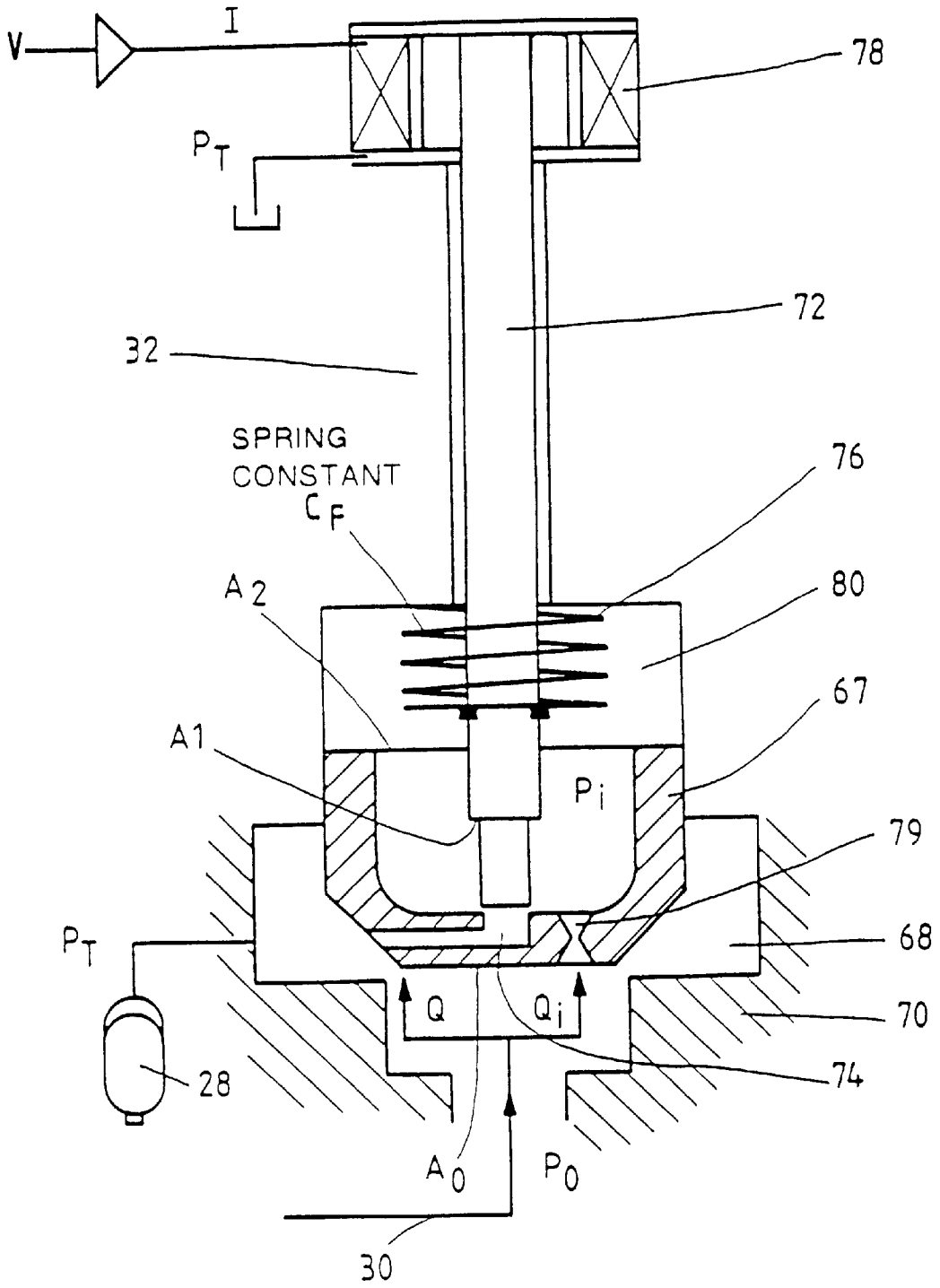
FIG. 4 is a damping valve used in a circuit in accordance with FIG. 3.

FIG. 4 shows an embodiment of a damping valve 32 or 33. This valve has a valve slide 67 which is guided in a valve bore 68 of a valve housing 70. The connection between the feed line 30, 31 and the hydraulic accumulator 28, 29 can be interrupted via the valve slide 67 or be adjusted so as to have a variable opening cross section. The valve slide 67 is of cup-shaped construction, it having associated with it a pilot valve the control needle 72 of which extends into the space formed by the valve slide 67. By it, an outlet opening 74 formed in the bottom of the valve slide which discharges into the valve bore can be opened or closed. The control needle 72 is urged by a setting spring 76 in closing direction and can be controlled via a magnetic coil 78. In the bottom of the valve slide 67 there is finally also a feed hole 79 which connects the feed line 30, 31 with the control space 80 of the pilot valve.

In its basic position, the valve slide 67 rests on its valve seat so that the connection between the hydraulic accumulator 28 and the feed line 30 is interrupted. The hydraulic fluid in the feed line 30 acts on the end surface $A_0$ of the valve slide and passes via the feed throttle 79 into the control space 80 so that a rear side $A_2$ of the valve slide is acted on by pressure. Furthermore, a stepped surface $A_1$ of the control needle 72 is acted on. With a corresponding pressure $P_0$ of the hydraulic fluid, the control needle 72 is moved upward against the tension of the setting spring 76, so that the discharge opening 74 is opened and a control volumetric flow $K_1$ sets in which results in a pressure drop in the control space 80 until the force acting on the rear side $A_2$ of the valve slide is equal to the force acting on the valve slide end surface $A_0$. Upon a further increase of the pressure in the feed line 30, the valve slide 67 is raised so that the connection to the hydraulic accumulator 28 is opened. The hydraulic coupling of the main valve with the valve slide to the pilot valve assures a function which advantageously stabilizes itself against external disturbances such as frictional and flow forces. Upon the use of such a damping valve 32, a linear characteristic curve is obtained, i.e. a proportional dependence of the flow on the pressure difference. By corresponding control via the magnetic coil 78, characteristic curves of different inclination can be established, so that in the optimum case an infinitely adjustable family of characteristic curves can be obtained, by which the damping characteristic can be varied within wide limits.

However, there may also be used damping valves 32 in which a predetermined number of discrete intermediate stages can be called upon, in which connection then, instead of a proportional valve, there can be used a solution having a plurality of switch valves which make it possible, for instance, to set three intermediate stages.

Upon the placing in operation of the entire system, first of all, and then the switch valve 56, the further switch valve 60 and the directional control valve 44 are brought into their open positions and the hydraulic accumulators 28, 29 and the cylinder chambers 20 of the cylinders 16, 17 are provided with hydraulic fluid. At the same time, the annular spaces of the pistons are acted on with the pump pressure via the bypass lines 46, 47. The hydraulic accumulators are then brought to their operating pressure and the pistons 18 of the cylinders are held in their central position.

Since the hydraulic system is loaded when cold, there may be increases in pressure during the operation of the rail vehicle in case of an increase in the temperature. These pressure increases can be released into the tank T via the pressure-limiting valves 52, used as safety valves.

Upon travel around a curve, the car body 2 can shift laterally with respect to the truck 4 in the manner, for instance, that the cylinder chamber 20 on the right in FIG. 3 is acted on with pressure via the pressure-reduction valve 41 and the directional control valve 44, while the cylinder chamber on the left is connected via the directional control valve 44 and the pressure-reduction valve 40 to the tank T, for which purpose the pressure-reduction valve 40 is suitably activated by its control 36. With the transverse spring action activated, upon travel around a curve the two damping valves 32, 33 are brought into an open position, while the switch valve 56 is closed. Oscillations are dampened by the throttling action of the damping valves 32, 33. By means of the two bypass lines 46, 47, assurance is had that only that damping valve 32 or 33 is active over which a build-up of pressure in the direction towards the hydraulic accumulators 28, 29 takes place. The other damping valve 33 or 32 is then circumvented by the return flow from the corresponding hydraulic accumulator 28, 29 via the bypass line 46, 47 and the non-return valve 48. The damping action can be controlled by corresponding control of the damping valves 32, 33 via the transverse damping control 34, so that different degrees of damping can be set.

By the bringing of the switch valve into its open position, the short-circuit line 54 between the two hydraulic accumulators 28, 29 can be opened. With the damping valves open, the hydraulic fluid is then merely pumped back and forth between the annular spaces 26, 27; the transverse spring action is then practically without effect. By corresponding control of the pressure-reduction valves 40, 41, a corresponding initial pressure which also produces a damping of the transverse compensator movement can be set in the cylinder chamber 20 which decreases in size.

In the event that the control of the damping valves 32, 33 fails, these valves are automatically brought by the spring action into a condition into which a maximum throttling action is present and thus the hardest damping stage is set. Furthermore, the system can be provided with an emergency spring which, in case of failure of the hydraulic circuit, takes over the transverse spring action. Upon failure of the control, the directional control valve 44 is brought into the position shown, in which the two cylinder chambers 20 are connected with each other. Equilibrium is then established between the forces acting on the ends of the pistons 18. The transverse movements of the car body are then no longer affected by the active transverse compensator. Furthermore, in case of failure of the control, the switch valve 56 is brought into its closed position, so that the hydropneumatic spring action remains active. In this way, the comfort of travel to be sure changes insignificantly in the case of certain conditions of travel, but the safety of travel is increased.

For the monitoring of the pressure, several pressure sensors are provided in the hydraulic system, their signals being fed to the controls.

Figure 5:
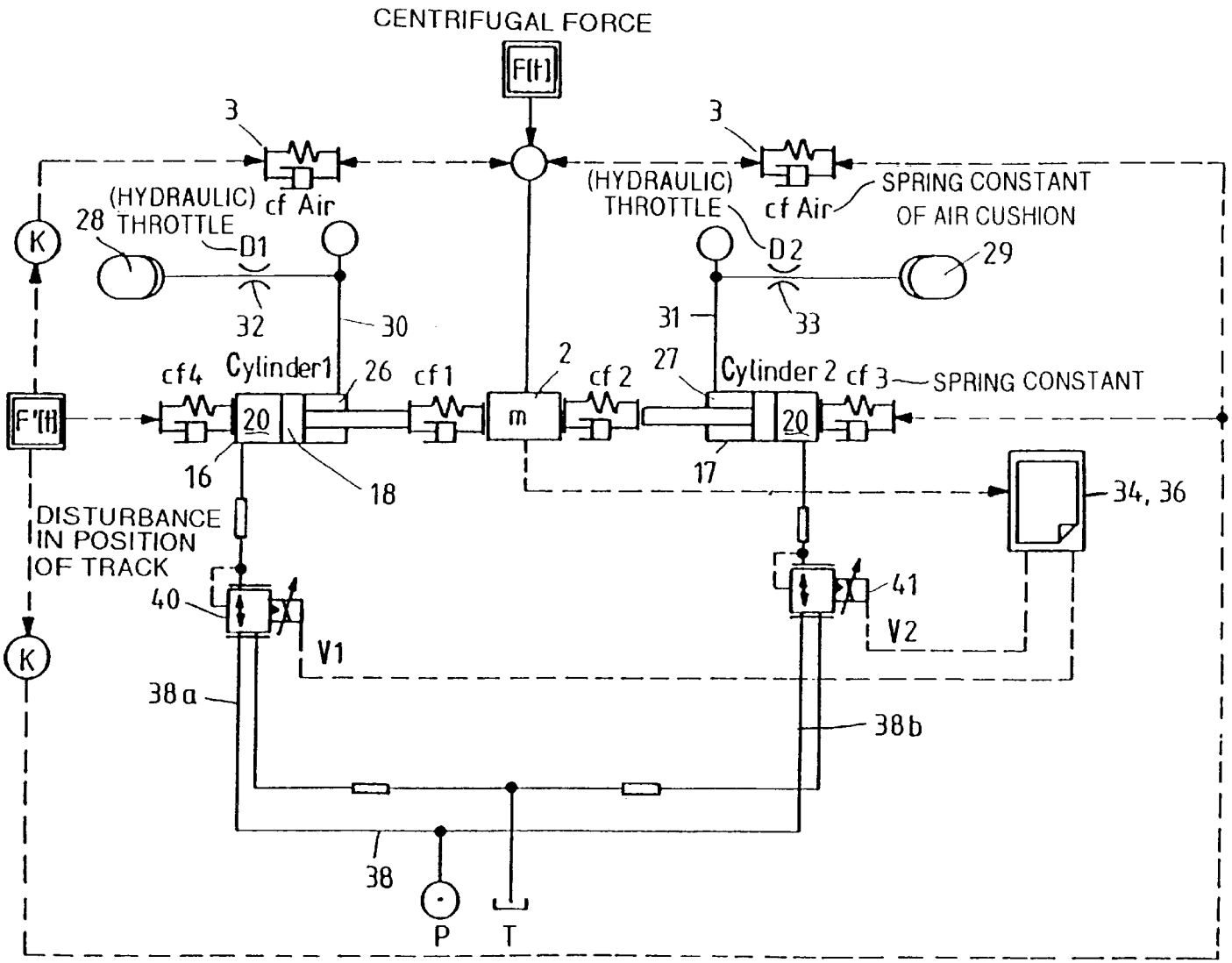
FIG. 5 is a simulation model for the simulating of the travel dynamics of a rail vehicle having transverse spring action.

FIG. 5, finally, shows a simulation model with which the dynamics of travel of an undercarriage provided with the transverse compensation device of the invention can be simulated.

In it, m is the weight of the car body on which the pistons 18 of the cylinders 16, 17 act. The cylinder chambers 20 of the cylinders 16, 17 can be connected optionally by the pressure-reduction valves 40, 41 to the pump P or the tank T. The annular spaces 26, 27 of the cylinders 16, 17 are connected with the hydraulic accumulators 28, 29, the damping valve 32, 33 being provided in the feed lines 30, 31.

Parallel to the transverse compensator 12 with the transverse spring action 14 there are arranged the (secondary) air springs 30 which form the vertical and in part also transverse support of the car body 2.

Desired conditions of travel can be simulated in the manner that the car body 2 and/or the truck is acted on by forces which simulate the centrifugal force F(t) and the forces F' (t) caused by disturbances in the position of the track, etc. The pressure-reduction valves 40, 41 and the damping valves 32, 33 are controlled via their controls 34, 36.

With the system in accordance with the invention, a preferably hydropneumatically acting transverse spring action is associated with the transverse compensator, the spring action being connected optionally as a function of the travel run, the runway, and the nature of the runway. The transverse spring can furthermore also be combined with a preferably active damping system in order effectively to dampen high-frequency oscillations. By the system in accordance with the invention, the quasi-static transverse force can be held in the cylinders by active pressure control. The dynamic transverse oscillations are taken up by the secondary air springs and the transverse springs.

Upon straight-ahead travel, the secondary air springs dampen dynamic oscillations alone. In this way, a very soft, effective transverse spring stiffness is obtained. The hydropneumatic additional spring action can be disconnected, while the damping of the transverse compensator remains active at all times. The compensator then acts in the manner of a conventional hydraulic transverse damper.

We claim:

1. A device for compensating transverse forces acting on a rail vehicle, wherein the rail vehicle comprises a car body, at least one undercarriage, a first spring means, the car body being supported by said first spring means on the undercarriage, the compensating device comprising:

a transverse compensator, a control circuit, and transverse spring means, wherein the transverse compensator comprises first and second cylinders and first and second hydraulic accumulators;

wherein said transverse compensator is controllable via said control circuit for shifting the car body transverse to the undercarriage for damping dynamic transverse oscillations;

a pressure medium is supplied to a first cylinder chamber of said first cylinder for urging a transverse displacement of the car body in one direction, the pressure medium is supplied to a first cylinder chamber of said second cylinder for urging a transverse displacement of the car body in a direction opposite to the first direction; and for a cushioning of dynamic transverse vibrations, a second cylinder chamber of the first cylinder is connected to said first hydraulic accumulator and the second cylinder chamber of the second cylinder is connected to said second hydraulic accumulator.

2. A device according to claim 1, further comprising closable hydraulic feed lines connecting said first and said second cylinders respectively to said first and said second hydraulic accumulators.

3. A device according to claim 2, further comprising first and second damping devices, wherein, said first and said second damping devices are switched into said feed lines between respective ones of said hydraulic accumulators and respective ones of said cylinders.

4. A device according to claim 3, wherein a degree of damping of said damping devices is variable as a function of travel parameters of the rail vehicle.

5. A device according to claim 4, wherein each of said damping devices comprises a proportional valve with variable diaphragm cross section.

6. A device according to claim 3, further comprising first and second non-return valves bridging over respective ones of said first and said second damping devices.

7. A device according to claim 1, further comprising a switch valve, and a connection which is openable and closable by said switch valve, said connection being provided between said first and said second hydraulic accumulators.

8. A device according to claim 1, wherein each of said first and said second cylinders of the transverse compensator comprises a piston, and wherein in each of said first and said second cylinders, there is a reduction body which protrudes into said first cylinder chambers; and extends into a corresponding recess in a piston of the cylinder.

9. A device according to claim 1, wherein each of said first and said second cylinders comprises a piston which is pivoted to the car body.

10. A device according to claim 1, further comprising an incoming pressure line and a directional control valve, wherein said first cylinder chambers of respective ones of said cylinders are connectable, via said directional control valve, to each other in a first switch position of said valve and are connectable to the pressure line in a second switch position of said valve.

11. A device according to claim 10, further comprising first and second pressure-reduction valves, and wherein in said second switch position, feed lines from respective ones of said cylinders connect via respective ones of said pressure-reduction valves selectively to a pressure source or to a return tank for developing a predetermined cylinder pressure.

12. A device according to claim 11, wherein the pressure source is a constant-pressure pump.

13. A device according to claim 12, wherein the pump of the pressure source supplies both said transverse compensator and both of said hydraulic accumulators with hydraulic pressure.

* * * * *